US010435946B2

(12) United States Patent
Nielsen

(10) Patent No.: US 10,435,946 B2
(45) Date of Patent: Oct. 8, 2019

(54) COLLAPSIBLE LADDER

(71) Applicant: Otto Martinus Nielsen, Hoersholm (DK)

(72) Inventor: Otto Martinus Nielsen, Hoersholm (DK)

( * ) Notice: Subject to any disclaimer, the term of this patent is extended or adjusted under 35 U.S.C. 154(b) by 0 days.

(21) Appl. No.: 15/779,151

(22) PCT Filed: Nov. 24, 2016

(86) PCT No.: PCT/DK2016/050394
§ 371 (c)(1),
(2) Date: May 25, 2018

(87) PCT Pub. No.: WO2017/088891
PCT Pub. Date: Jun. 1, 2017

(65) Prior Publication Data

US 2018/0340370 A1 Nov. 29, 2018

(30) Foreign Application Priority Data

Nov. 28, 2015 (DK) ..... 2015 00762

(51) Int. Cl.
*E06C 1/22* (2006.01)
*E06C 1/12* (2006.01)
(Continued)

(52) U.S. Cl.
CPC ..... *E06C 1/125* (2013.01); *E06C 1/22* (2013.01); *E06C 5/04* (2013.01); *E06C 7/08* (2013.01)

(58) Field of Classification Search
CPC ..... E06C 1/125
See application file for complete search history.

(56) References Cited

U.S. PATENT DOCUMENTS 6,253,936 B1 * 7/2001 Kong ..... A61J 9/001 215/11.1
7,048,094 B2 5/2006 Kieffer et al.
(Continued)

FOREIGN PATENT DOCUMENTS

EP 0527766 B1 6/1996
EP 1728966 A1 12/2006
(Continued)

OTHER PUBLICATIONS

European Search Report for European Patent Application No. 16868066.8, dated Aug. 24, 2018, 4 pages.
(Continued)

*Primary Examiner* — Alvin C Chin-Shue
(74) *Attorney, Agent, or Firm* — Ziegler IP Law Group, LLC

(57) ABSTRACT

A collapsible ladder includes two vertical stiles with rungs disposed therebetween. Each stile is formed by a plurality of telescopically collapsible columns. Each collapsible column has a bottom opening, an inner wall and a cover to cover the bottom opening. The cover has a small cylindrical portion and a large cylindrical portion with a peripheral surface located under the small cylindrical portion. The small cylindrical portion is inserted into the bottom opening of a column The large cylindrical portion is exposed outside of the column and inserted inside of a next lower column. A sealing ring is disposed inside a annular groove and touches the inner wall of the next lower column when the stile is extending or collapsing. One or more air ducts are provided in the cover. A first air opening iarranged above the large cylindrical portion in correspondence with an opening in a lower wall part of the column.

12 Claims, 4 Drawing Sheets

(51) Int. Cl.
*E06C 5/04* (2006.01)
*E06C 7/08* (2006.01)

(56) References Cited

U.S. PATENT DOCUMENTS

| | | | | |
|---|---|---|---|---|
| 2005/0183710 | A1* | 8/2005 | Lapointe | F41B 11/00 124/65 |
| 2006/0283664 | A1 | 12/2006 | Yao | |
| 2010/0044155 | A1* | 2/2010 | Kieffer | E06C 1/125 182/195 |
| 2011/0192679 | A1* | 8/2011 | Kuo | E06C 1/125 182/108 |
| 2014/0190766 | A1* | 7/2014 | Parker | E06C 9/08 182/93 |

FOREIGN PATENT DOCUMENTS

| | | | |
|---|---|---|---|
| EP | 2343433 | A1 | 7/2011 |
| EP | 2770155 | A1 | 8/2014 |
| GB | 2305956 | A | 4/1997 |
| JP | 2011074749 | A | 4/2011 |
| WO | 2017/088891 | A1 | 6/2017 |

OTHER PUBLICATIONS

International Search Report, Application No. PCT/DK2016/050394, dated Feb. 27, 2017, 4 pages.

* cited by examiner

COLLAPSIBLE LADDER

FIELD

The aspects of the disclosed embodiments relate to a collapsible ladder of the type comprising U-shaped ladder sections being telescopically inserted in each other.

BACKGROUND

Extendable ladders are ladders, which may be extended for use and folded for storage when not used. In the European patent EP-B1-0 527 766 a collapsible ladder is described comprising ladder bars divided into sections interconnected by rungs. In each ladder section is provided retaining or locking mechanisms, designed to automatically release the upper ladder sections, when a rung reaches a lower rung. This means, that subsequent to the release of the lowermost ladder section, the following ladder sections are automatically released, whereby the ladder collapses. However, when collapsing the ladder, the rungs are collapsing on top of each other, thereby generating a safety problem for the user's hands and fingers.

Thus, there is a need for a collapsible ladder, which allows the ladder sections to be automatically released by release of the lowermost ladder section, but which provides a safety distance between the rungs to avoid injuries of a users hands or fingers.

U.S. Pat. No. 7,048,094 also discloses an extendable ladder, which ladder comprises: a first stile, a second stile and a plurality of rungs disposed between the first stile and the second stile, the first stile being composed of a first column assembly including a first column and a second column assembly including a second column, the first column having an internal surface, and the second column being connected with the first column in a nested arrangement to form a telescopic mechanism capable of movement lengthwise; a locking mechanism for selectively locking the second column with respect to the first column; a button operably connected to the locking mechanism for controlling the locking mechanism; a ring is coupled to the first column proximate a distal end thereof, and the second column includes a sleeve coupled to the second column proximate a proximal end thereof. The sleeve includes an external guiding surface for contacting the internal surface of the first column and the ring includes an internal guiding surface for contacting an exterior surface of the second column. The columns are made of Aluminium while the ring and the sleeve are made of a plastic material.

However, the sleeve is made of a relatively thin plastic material and may be worn out during use, whereby its function for providing a guiding surface is reduced. Thus, there is a need for a collapsible ladder, for which a first collapsible column is provided with a guiding part for guiding the first column into a next lower, second column, and for which the guiding part is not easily worn out.

SUMMARY

According to a first aspect of the disclosed embodiments there is provided a collapsible ladder comprising:

two vertical stiles with a plurality of rungs disposed between two stiles, each stile being formed by a plurality of telescopically collapsible columns;

wherein each or at least part of the collapsible columns has a bottom opening and an inner wall and receives a cover at the bottom opening to cover the bottom opening; wherein the cover has a small cylindrical portion and a large cylindrical portion with a peripheral surface located under the small cylindrical portion;

the small cylindrical portion is inserted into the bottom opening of a column and is positioned inside the column, while the large cylindrical portion is exposed outside of the column and inserted inside of a next lower column;

an annular groove is formed on the peripheral surface of the large cylindrical portion;

a sealing ring is disposed inside the annular groove, with the sealing ring touching the inner wall of the next lower column when the stile is extending or collapsing, said sealing ring forming a frictional seal for the next lower column and dividing the next lower column into an upper part above the sealing ring and a lower part below the sealing ring; and wherein one or more air ducts are provided in the cover, each air duct having a first air opening and a second air opening, with the first air opening arranged above the large cylindrical portion and in correspondence with an opening in a lower wall part of the column receiving the cover, whereby the first air opening faces the inside or the interior of the upper part of the next lower column, and with the second air opening facing a bottom part of the cover and the inside or the interior of the lower part of the next lower column, thereby enabling air to exit from the upper part to the lower part of the next lower column.

It is preferred that an elastic or elastomeric seal or film is provided at the bottom of the cover and secured to a bottom part of the cover, said seal extending beneath the second air openings facing the bottom of the cover. The elastic or elastomeric seal or film may be secured to the bottom part of the cover and extend beneath the second air openings so as to cover the second air openings.

It is preferred that the elastic or elastomeric seal or film is secured to the bottom part of the cover for sealing the second air openings when the stile is collapsed by having the upper column being collapsed into the next lower column, and for unsealing the second air openings when the stile is extended by extending the upper column outwards or upwards from the next lower column.

It is within one or more embodiments of the first aspect of the invention that an auxiliary sealing ring is disposed between the bottom of the small cylindrical portion of the cover and the inner wall of the column.

It is also within one or more embodiments of the first aspect of the present disclosure that at least one protruding ring part is formed in each or at least part of the collapsible columns, wherein the outer diameter of the ring part is larger than the outer diameter of the column in which the ring part is formed, and smaller than the inner diameter of a next lower column.

According to a second aspect of the present disclosure there is provided a collapsible ladder comprising:

two vertical stiles with a plurality of rungs disposed between two stiles, each stile being formed by a plurality of telescopically collapsible columns;

wherein at least one protruding ring part is formed in at least part of the collapsible columns, wherein the outer diameter of the ring part is larger than the outer diameter of the column in which the ring part is formed, and smaller than the inner diameter of a next lower column.

For the second aspect of the present disclosure it is preferred that at least part of the collapsible columns have a bottom opening and an inner wall and receives a cover at the bottom opening to cover the bottom opening. It is preferred that the outer diameter of the cover is smaller than the outer diameter of the protruding ring part. It is also preferred that the cover has a small cylindrical portion and a large cylindrical portion with a peripheral surface located under the small cylindrical portion, and that the small cylindrical portion is inserted into the bottom opening of a column and is positioned inside the column, while the large cylindrical portion is exposed outside of the column and inserted inside of a next lower column. An auxiliary sealing ring may be disposed between the bottom of the small cylindrical portion of the cover and the inner wall of the column.

For both the first and second aspects of the present disclosure it is preferred that at least two protruding ring parts are formed in each or at least part of the collapsible columns.

It is within one or more embodiments of the first and second aspects of the present disclosure that one or more columns having a protruding ring part have a locking hole for receiving a locking pin, and wherein a first protruding ring part is formed above said locking hole. It is preferred that a second protruding ring part is formed below said locking hole. It is also preferred that protruding ring part(s) is/are formed in a column by a rolling process. Here the column may be made of Aluminium with the protruding ring part(s) being formed in the Aluminium.

For embodiments of the first and second aspect of the present disclosure having a bottom cover, it is preferred that the bottom cover has a sloped nose or protruding part extending from the bottom of the cover and arranged so as to push a locking pin received in a locking hole of the next lower column.

DETAILED DESCRIPTION OF EMBODIMENTS

Figure 1:
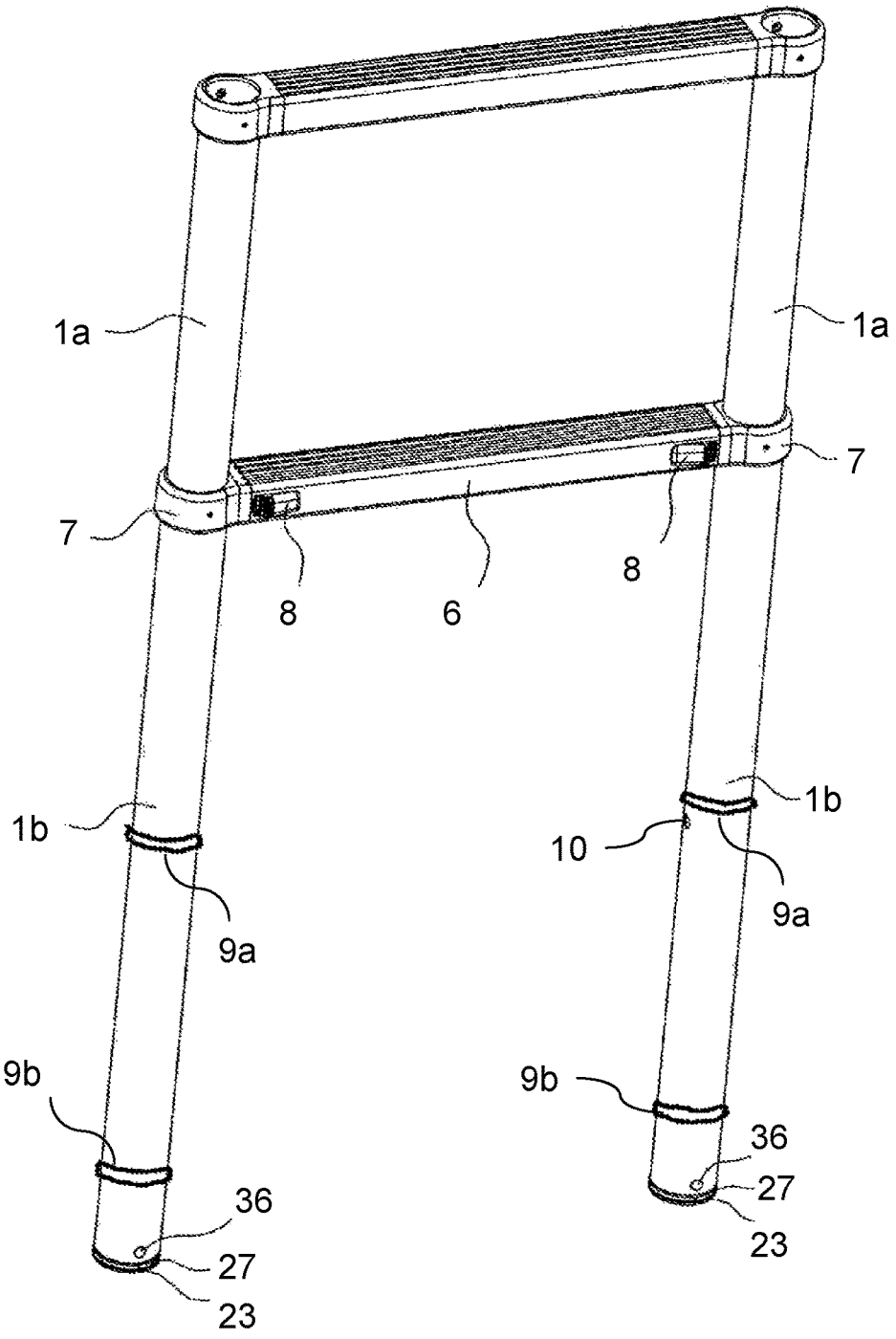
FIG. 1 is a perspective view of an extendable ladder in accordance with an embodiment of the present disclosure when the columns are extended.
Figure 2A:
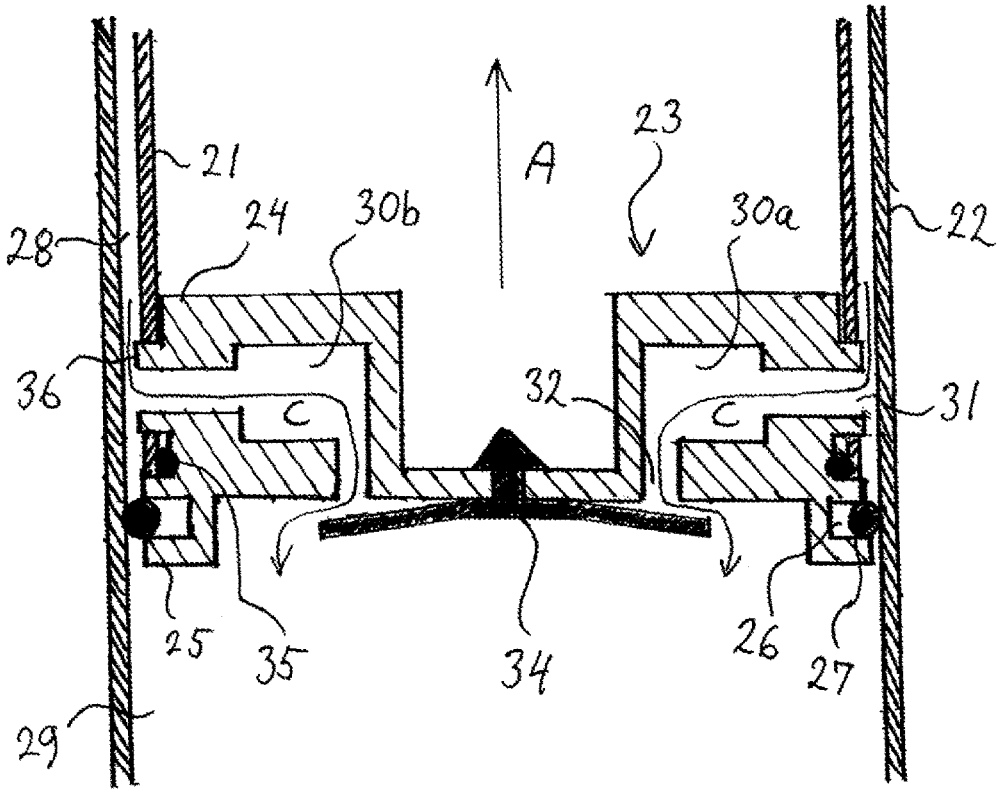
FIG. 2*a* is a sectional perspective view of parts of an extendable ladder in accordance with an embodiment of the present disclosure when the columns are extending.
Figure 2B:
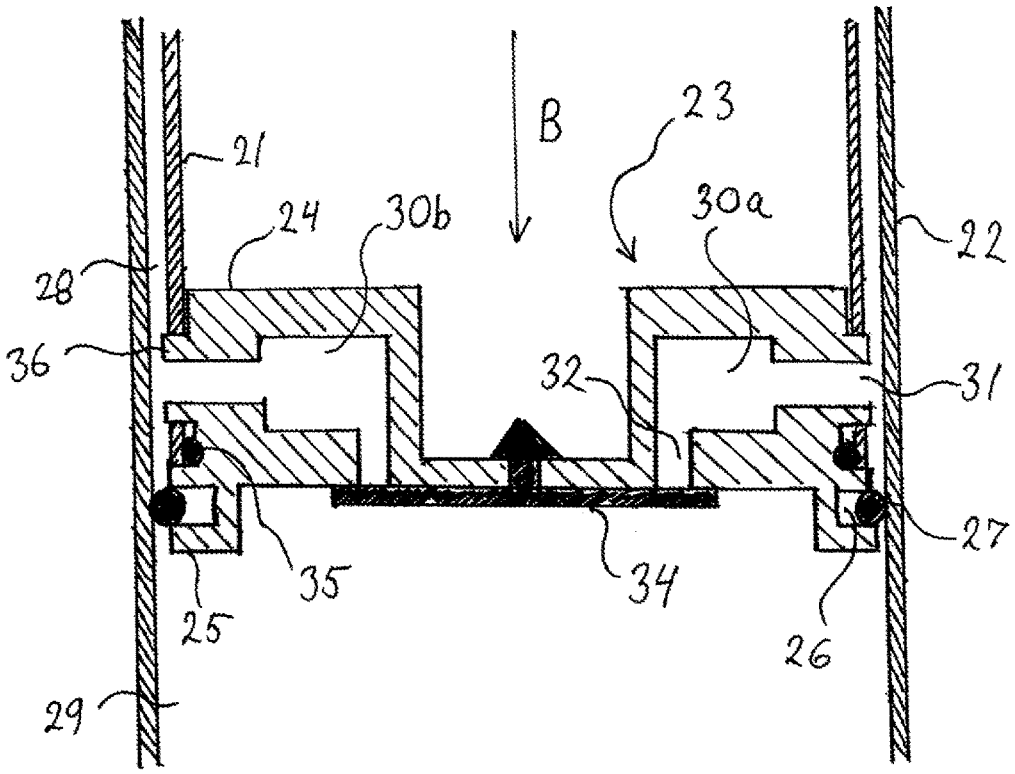
FIG. 2*b* is a sectional perspective view of the ladder parts illustrated in FIG. 2*a* when the columns are collapsing.
Figure 3:
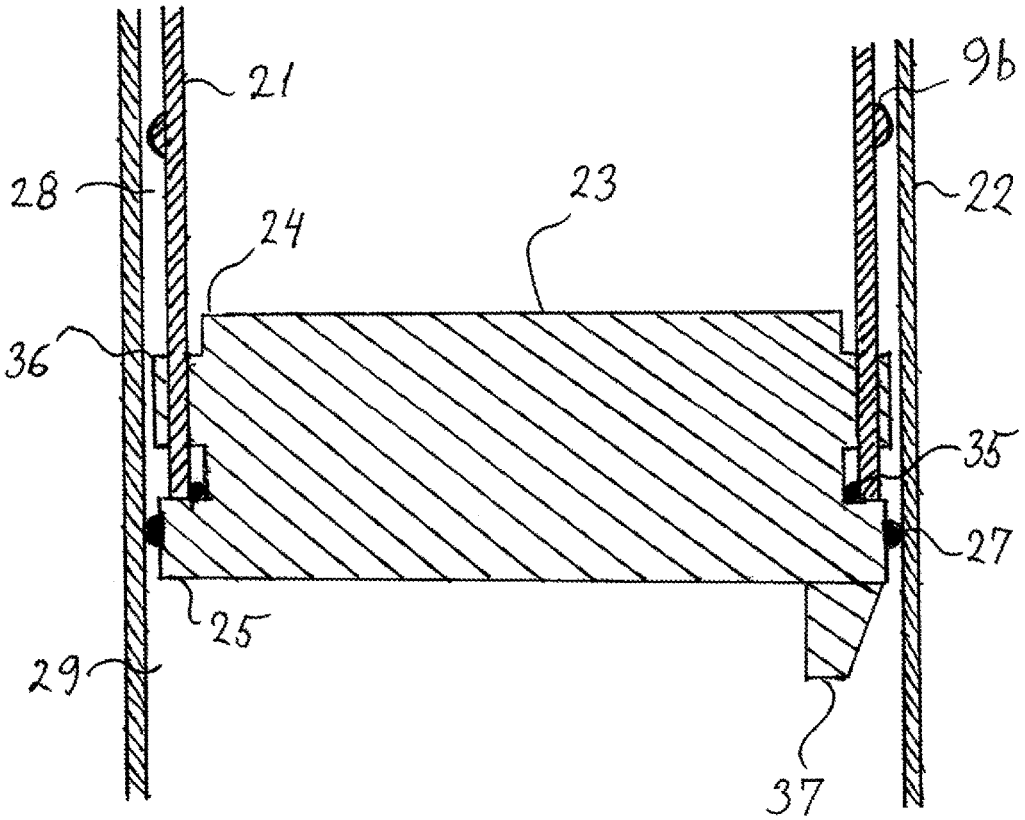
FIG. 3 illustrates the arrangement of a cover at the bottom of a column according to an embodiment of the present disclosure.

FIGS. 1 to 3 show preferred embodiments of the present disclosure. The extendable ladder of FIG. 1 comprises two vertical stiles with a plurality of rungs 6 disposed between two stiles, each stile being formed by a plurality of telescopically collapsible columns 1*a*, 1*b*, each column 1*a*, 1*b* being connected to the corresponding rung 6 via a connecting sleeve 7; a plug or locking pin is disposed inside the connecting sleeve 7, which can move horizontally and transversely with respect to the connection sleeve 7 and be exposed outside to lock the column 1*a* together with the next lower column 1*b*; a spring disposed inside the connection sleeve 7, which can keep the plug pin in the trend of being exposed outside; a locking hole 10 is provided in the column 1*a*, 1*b* for receiving the plug or locking pin, and a push button 8 or release lever may be provided which can drive the plug pin to move transversely to lock or unlock a column 1*a*, 1*b* into a next lower column 1*a*, 1*b*.

The foregoing shows the conventional structure of an extendable ladder. According to an embodiment of the present disclosure and illustrated in FIGS. 1, 2*a*, 2*b* and 3, there is provided an extendable ladder for which: each or at least part of the collapsible columns 1*a*, 1*b*, 21, 22 has a bottom opening and an inner wall and receives a cover 23 at the bottom opening to cover the bottom opening; the cover 23 has a small cylindrical portion 24 and a large cylindrical portion 25 with a peripheral surface located under the small cylindrical portion 24; the small cylindrical portion 24 is inserted into the bottom opening of a column 21 and is positioned inside the column 21, while the large cylindrical portion is exposed outside of the column and inserted inside of a next lower column 22; an annular groove 26 is formed on the peripheral surface of the large cylindrical portion 25; a sealing ring 27 is disposed inside the annular groove 26, with the sealing ring 27 touching the inner wall of the next lower column 22 when the stile is extending or collapsing, whereby the sealing ring 27 forms a frictional seal for the next lower column 22 and dividing the next lower column 22 into an upper part 28 above the sealing ring and a lower part below the sealing ring 29; one or more, such as two air ducts 30*a*, 30*b* are provided in the cover 23, where each air duct 30*a*, 30*b* has a first air opening 31 and a second air opening 32, with the first air opening 31 arranged above the large cylindrical portion 25 and in correspondence with an opening 36 in a lower wall part of the column 21 receiving the cover 23, whereby the first air opening 31 faces the inside or the interior of the upper part 28 of the next lower column 22, and with the second air opening 32 facing a bottom part of the cover 23 and the inside or the interior of the lower part 29 of the next lower column 22, thereby enabling air to exit from the upper part 28 to the lower part 29 of the next lower column 22.

It is preferred that an elastic or elastomeric seal or film 34 is provided at the bottom of the cover 23 and secured to a bottom part of the cover, where the seal 34 extends beneath the second air openings 32 facing the bottom of the cover 23. The elastic or elastomeric seal or film 34 may be secured to the bottom part of the cover 23 and extend beneath the second air openings 32 so as to possible cover the second air openings 32. The elastic or elastomeric seal or film 34 is secured to the bottom part of the cover for sealing the second air openings 32 when the stile is collapsed by having the upper column 21 being collapsed into the next lower column 22, and for unsealing the second air openings 32 when the stile is extended by extending the upper column 21 outwards or upwards from the next lower column 22. An auxiliary sealing ring 35 may be disposed between the bottom of the small cylindrical portion 24 of the cover 23 and the inner wall of the column 21.

For ladders of the present invention having columns 21 provided with a bottom cover 23, then FIG. 2*a* shows a sectional cut through view of parts of the extendable ladder, when the columns 1*a*, 1*b*, 21, 22 are extending, and FIG. 2*b* shows the same cut through view when the columns 1*a*, 1*b*, 21, 22 are collapsing. FIG. 3 is not a cut through view of the bottom cover 23, but illustrates the arrangement of the cover 23 at the bottom of a column 1*a*, 21. The bottom cover of FIG. 3 is also provided with a sloped nose or protruding part 37 extending from the bottom of the cover 23 and arranged so as to push a locking pin received in a locking hole 10 of the next lower column 1*b*, 22.

During the collapsing of the upper column 21 into the next lower column 22, the seal 34 is moved slides upward relatively to the bottom of the cover 23, thereby closing the second air openings 32 of the air ducts 30*a*, 30*b*, and air is not passed through the air ducts 30*a*, 30*b*, so the collapsing of the column 21 is slowed down due to resistance of air inside the closed spaced at the interior 29 of the next lower column 22. Due to the slowed collapsing, a person may have enough reaction time to withdraw his/her fingers in time even through the fingers are just in an inappropriate position. In addition, since the speed of the collapsing of the ladder is slowed down, the force applied to the fingers is quite small even if the fingers are crushed. Therefore, the purposes of preventing finger injury and eliminating potential safety hazards are achieved. In addition, when the columns move upward while the extendable ladder is extending for use, the seal 34 is moved downwards thereby opening the second air openings 32, and air can exit without resistance through the air ducts 30*a*, 30*b* from the upper part 28 to the lower part 29 of the next lower column 22.

The present disclosure also covers embodiments of a collapsible ladder, wherein at least one protruding ring part 9*a*, 9*b* is formed in each or at least part of the collapsible columns 1*a*, 1*b*, 21, 22, wherein the outer diameter of the ring part 9*a*, 9*b* is larger than the outer diameter of the column 1*a*, 1*b*, 21, 22 in which the ring part 9*a*, 9*b* is formed, and smaller than the inner diameter of a next lower column. This is illustrated in FIG. 1 where two protruding ring parts 9*a*, 9*b* are shown on the next lower column 1*b*. A lowermost protruding ring part 9*b* is also shown on the inner column 21 in FIG. 3. It is preferred that at least part of the collapsible columns 1*a*, 1*b*, 21 provided with one or more protruding ring parts 9*a*, 9*b* have a bottom opening and an inner wall and receives a cover 23 at the bottom opening to cover the bottom opening. The present invention also covers embodiments for which the outer diameter of the cover 23 is smaller than the outer diameter of the protruding ring part 9*a*, 9*b*. The cover 23 may have a small cylindrical portion 24 and a large cylindrical portion 25 with a peripheral surface located under the small cylindrical portion 24, and the small cylindrical portion may be inserted into the bottom opening of a column 21 and positioned inside the column, while the large cylindrical portion may be exposed outside of the column and inserted inside of a next lower column 22. Here, an auxiliary sealing ring 35 may be disposed between the bottom of the small cylindrical portion 24 of the cover and the inner wall of the column 21. One or more of the collapsible columns 1*a*, 1*b*, 21, 22 having a protruding ring part 9*a*, 9*b* have a locking hole 10 for receiving a locking pin, and it is preferred that a first protruding ring part 9*a* is formed above the locking hole 10. It is also preferred that a second protruding ring part 9*b* is formed below the locking hole 10, and the second protruding ring part 9*b* may be arranged with a distance to the locking hole 10 being larger than the distance to the bottom of the column 1*b*. The column 1*a*, 1*b* may be made of Aluminium and the protruding ring part(s) 9*a*, 9*b* may be formed in the Aluminium by a rolling process.

The present disclosure also covers embodiments of a collapsible ladder wherein one or more columns 1*a*, 1*b* have a locking hole 10 for receiving a locking pin, and wherein the bottom cover 23 has a sloped nose or protruding part 37 extending from the bottom of the cover 23 and arranged so as to push a locking pin received in a locking hole of the next lower column. Such a sloped nose or protruding ring part 37 is shown at the cover 23 of FIG. 3.

By having one or more, such as two, protruding rings parts 9*a*, 9*b* formed in the collapsible columns 1*a*, 1*b* there is provided a solution for a collapsible ladder having guiding parts for guiding the a first upper column into a next lower, second column, which guiding part is not easily worn out.

The invention claimed is:

1. A collapsible ladder comprising:

two vertical stiles with a plurality of rungs disposed between the two vertical stiles, a stile of the two vertical stiles being formed by a plurality of telescopically collapsible columns;

wherein one or more of the plurality of telescopically collapsible columns has a bottom opening and an inner wall;

a cover configured to be received at the bottom opening of a respective column of the one or more of the plurality of telescopically collapsible columns to cover the bottom opening; wherein the cover has a small cylindrical portion and a large cylindrical portion with a peripheral surface located under the small cylindrical portion;

the small cylindrical portion is inserted into the bottom opening of the respective column and is positioned inside the respective column, while the large cylindrical portion is exposed outside of the respective column and inserted inside of a next lower column of the one or more of said plurality of telescopically collapsible columns;

an annular groove is formed on the peripheral surface of the large cylindrical portion;

a sealing ring is disposed inside the annular groove, with the sealing ring touching the inner wall of the next lower column when the stile is extending or collapsing, said sealing ring forming a frictional seal for the next lower column and dividing the next lower column into an upper part above the sealing ring and a lower part below the sealing ring; and wherein one or more air ducts are provided in the cover, each air duct having a first air opening and a second air opening, the first air opening disposed above the large cylindrical portion of the cover and within an opening defined between a lower wall part of the respective column receiving the cover and the interior of the upper part of the next lower column, whereby the first air opening faces the inside or the interior of the upper part of the next lower column, and the second air opening facing a bottom part of the cover and the inside or the interior of the lower part of the next lower column, thereby enabling air to exit from the upper part to the lower part of the next lower column.

2. A collapsible ladder according to claim 1, wherein an elastic or elastomeric seal or film is provided below the bottom part of the cover and secured to the bottom part of the cover, said seal extending beneath the second air openings facing the bottom part of the cover.

3. A collapsible ladder according to claim 2, wherein the elastic or elastomeric seal or film is secured to the bottom part of the cover and extending beneath the second air openings so as to cover the second air openings.

4. A collapsible ladder according to claim 2, wherein the elastic or elastomeric seal or film is secured to the bottom part of the cover for sealing the second air openings when the stile is collapsed by having the upper column being collapsed into the next lower column, and for unsealing the second air openings when the stile is extended by extending the upper column outwards or upwards from the next lower column.

5. A collapsible ladder according to claim 1, wherein an auxiliary sealing ring is disposed between the bottom of the small cylindrical portion of the cover and the inner wall of the column.

6. A collapsible ladder according to claim 1, wherein at least one protruding ring part is formed in each or at least part of the plurality of telescopically collapsible columns, wherein the outer diameter of the at least one protruding ring part is larger than the outer diameter of a column in which the at least one protruding protruding ring part is formed, and smaller than the inner diameter of a next lower column.

7. A collapsible ladder according to claim 6, wherein at least two protruding ring parts of the at least one protruding part are formed in each or at least part of the plurality of telescopically collapsible columns.

8. A collapsible ladder according to claim 6, wherein the one or more of said plurality of telescopically columns having the at least one protruding ring part have a locking hole for receiving a locking pin, and wherein a first protruding ring part of the at least one protruding ring part is formed above said locking hole.

9. A collapsible ladder according to claim 8, wherein a second protruding ring part of the at least one protruding ring part is formed below said locking hole.

10. A collapsible ladder according to claim 6, wherein the at least one protruding ring part is formed in a column by a rolling process.

11. A collapsible ladder according to claim 1, wherein one or more of said plurality of columns have a locking hole for receiving a locking pin, and wherein the bottom cover has a sloped nose or protruding part extending from the bottom of the cover and arranged so as to push a locking pin received in a locking hole of the next lower column.

12. The collapsible ladder according to claim 2, wherein a centre part of the elastic or elastomeric seal or film is secured to a centre part of the bottom part of the cover.

* * * * *